US007905821B2

(12) United States Patent
Stahlecker

(10) Patent No.: US 7,905,821 B2
(45) Date of Patent: Mar. 15, 2011

(54) DOUBLE-WALLED PAPERBOARD CUP

(75) Inventor: Werner Stahlecker, Goeppingen (DE)

(73) Assignee: PTM Packaging Tools Machinery PTE Ltd., Singapore (SG)

( * ) Notice: Subject to any disclaimer, the term of this patent is extended or adjusted under 35 U.S.C. 154(b) by 0 days.

(21) Appl. No.: 12/339,837

(22) Filed: Dec. 19, 2008

(65) Prior Publication Data

US 2009/0159653 A1 Jun. 25, 2009

Related U.S. Application Data

(62) Division of application No. 11/283,772, filed on Nov. 22, 2005, now Pat. No. 7,481,356.

(30) Foreign Application Priority Data

Nov. 22, 2004 (DE) ..... 10 2004 056 932

(51) Int. Cl.
*B31B 1/00* (2006.01)

(52) U.S. Cl. ..... 493/152; 493/439; 493/154; 493/155; 493/305

(58) Field of Classification Search ..... 493/152, 493/153, 154, 155, 160, 159, 439, 296, 308, 493/305, 306, 156, 158
See application file for complete search history.

(56) References Cited

U.S. PATENT DOCUMENTS

| | | | | |
|---|---|---|---|---|
| 1,756,243 | A * | 4/1930 | Benson | 493/108 |
| 2,288,602 | A | 7/1942 | Benton | |
| 3,139,213 | A | 6/1964 | Bryant | |
| 3,471,075 | A | 10/1969 | Wolf | |
| 3,485,412 | A | 12/1969 | Hawley | |
| 3,547,012 | A * | 12/1970 | Nicholas et al. | 493/109 |
| 3,580,468 | A | 5/1971 | McDevitt | |
| 3,612,346 | A | 10/1971 | Schneider | |
| 3,927,766 | A | 12/1975 | Day | |
| 4,231,476 | A * | 11/1980 | Compton et al. | 206/519 |
| 4,409,045 | A * | 10/1983 | Busse | 156/69 |
| 4,452,596 | A * | 6/1984 | Clauss et al. | 493/107 |
| 6,109,518 | A | 8/2000 | Mueller et al. | |
| 7,100,770 | B2 | 9/2006 | D'Amato | |
| 7,614,993 | B2 * | 11/2009 | Van Handel | 493/155 |

FOREIGN PATENT DOCUMENTS

| | | |
|---|---|---|
| DE | 1 191 285 A | 4/1965 |
| DE | 44 21 870 A1 | 1/1996 |
| DE | 198 40 841 A1 | 3/2000 |

(Continued)

OTHER PUBLICATIONS

British Search Report dated Dec. 21, 2005.

(Continued)

*Primary Examiner* — Sameh H. Tawfik
(74) *Attorney, Agent, or Firm* — Crowell & Moring LLP

(57) ABSTRACT

Described is a stackable, heat-insulating paperboard cup having an inner sleeve and an outer sleeve with a gap therebetween. A rolled lip is applied to the lower end of the outer sleeve, which rolled lip is disposed on the inner sleeve. A shoulder is formed on the inner sleeve for the rolled lip of another paperboard cup to be stacked. The diameter of the inner sleeve below the shoulder is reduced discontinuously. The support of the lower rolled lip on the outer surface of the inner sleeve is arranged at the same level as, or below, the cup bottom.

4 Claims, 9 Drawing Sheets

FOREIGN PATENT DOCUMENTS

| | | | |
|---|---|---|---|
| EP | 1 031 514 | | 8/2000 |
| EP | 1 227 042 | A1 | 7/2002 |
| EP | 1 227 043 | | 7/2002 |
| EP | 1 227 042 | B1 | 4/2004 |
| FR | 1.490.636 | | 8/1967 |
| GB | 971077 | | 9/1964 |
| GB | 1 261 532 | | 10/1972 |
| JP | 10-278931 | | 10/1998 |
| JP | 2000-203664 | A | 7/2000 |
| JP | 2001-180647 | A | 7/2001 |
| JP | 2007-149338 | A | 6/2007 |
| WO | WO 2007/054179 | A2 | 5/2007 |

OTHER PUBLICATIONS

Chinese Office Action dated Jan. 8, 2010 with English translation (nine (9) pages).

German Search Report dated Jul. 6, 2010 including partial English-language translation (Nine (9) pages).

* cited by examiner

DOUBLE-WALLED PAPERBOARD CUP

CROSS-REFERENCE TO RELATED APPLICATIONS

This application is a divisional of U.S. Application No. 11/283,772, filed Nov. 22, 2005, which claims priority under 35 U.S.C. §119 to German Patent Application No. DE 10 2004 056 932.0, filed Nov. 22, 2004, the entire disclosures of which are herein expressly incorporated by reference.

BACKGROUND AND SUMMARY OF THE INVENTION

The present invention relates to a double-walled, stackable and unstackable paperboard cup comprising an inner sleeve with a cup bottom, also comprising an outer sleeve with a gap between outer and inner sleeve, also comprising a rolled lip applied to the lower end of the outer sleeve and disposed on the inner sleeve, also comprising a stopping face formed on the inner sleeve for the rolled lip of another paperboard cup to be stacked.

A container of this type is prior art in European patent 1 227 042. A heat-insulating cup is described which comprises a conical inner sleeve and a conical outer sleeve, whereby the inner sleeve comprises an inwardly directed groove, which serves to permit the stacking of an identical cup inside said cup to be stacked. The inwardly directed groove, formed by means of rolling, should serve to provide the cup with good stacking and unstacking properties so that a plurality of stacked cups do not get stuck inside one another. Experience has shown that the stacking properties are satisfactory for approximately 20 cups. If more than this number of cups are stacked together, they become stuck. This is caused particularly by axial pressure, directed from the cup opening to the cup bottom, which is generated by the weight of many cups stacked on top of each other. Even the moderate setting down of 50 packed and stacked cups can result in them becoming stuck to one another. The cause of this getting stuck together must be seen in the insufficient stiffness of the groove, which, however, cannot be improved while applying this method of production, as the rolling results in a weakness in the material.

It is an object of the present invention to significantly improve the stacking and unstacking properties of paperboard cups of the above mentioned type. In particular, in contrast to prior art, a significantly greater number of cups should be stackable, which in particular do not become stuck to one another when a large number of stacked cups are set down with a jolt, or when in any other way a high level of axial pressure acts on the stacked cups, for example when a container magazine is filled. In addition thereto, an improved form stability of the inner sleeve is to be achieved by means of a particular position of the support of the lower rolled lip of the outer sleeve, so that when a cup is being removed from a magazine, it does not stick to the cup into which it is stacked.

This object has been achieved in accordance with the present invention in that the stopping face is designed as a shoulder, below which the diameter of the inner sleeve is reduced discontinuously, and in that the support of the lower rolled lip is applied to the outer surface of the inner sleeve at the same level as, or below the level of, the cup bottom.

The stopping face is formed by a discontinuous reduction in the diameter of the inner sleeve, below which the diameter of the cup remains constant at a certain level. The original conus of the inner sleeve continues again below this cylindrical area. The reduction in diameter is achieved by means of a special forming process, which is described below. By means of the forming process of the stopping face a material strengthening and a material thickening is achieved in the cylindrical area directly below the stopping face, which gives this area an increased stability. The stopping face becomes more resistant to deformation, whereby a high resistance to pressure is achieved. In addition, the angle of inclination of the stopping face, denoted by $\alpha$ in FIGS. 3 and 4, and the depth of the indentation p, influence the stability of the inner sleeve and thus the overall stackability of the cup. In practical embodiments, the depth of the indentation p lies in the range between 0.4 and 1 mm and the angle of inclination $\alpha$ of the stopping face in the range between 20° and 50°. Thus very stable inner sleeves are created, which withstand extreme loads acting in the direction of the cup axis and amounting to more than 200 N, thus avoiding sticking together of the cups.

Even angles of inclination $\alpha$ in the range between 0° and 20° are possible even when the design of the cup is more complicated. The most form-stable stopping surfaces are achieved for these angles of inclination. However, particularly in the case of these embodiments, pressing must take place at increased temperatures, as the inner layer of the inner sleeve would otherwise tear. The inner sleeve of cups of this type are usually made of paperboard, whereby the inner side is covered with a thin layer of a synthetic material. Polyethylene is used in most cases.

If the inner layer is torn, this renders the cup unusable, as it would become moist in the area of the tear due to contact with the liquid therein. An increase in temperature at the form station to a temperature somewhat below the so-called glass transition temperature (softening temperature) of the inner layer fulfills the requirements for making the layer so ductile that even angles of inclination $\alpha$ of the stopping face in the range of between 0° and 20° are possibe without the layer tearing.

In addition, the form stability of the inner sleeve is increased in that the support of the lower rolled lip is applied to the outer surface of the inner sleeve at the level of the cup bottom or below the cup bottom.

The cup can be produced with or without a shoulder in the area of its opening. The application of an upper shoulder results in a greater gap between the inner sleeve and the outer sleeve, which creates a higher thermal insulation. The upper shoulder, however, has no influence on the stacking properties of the cup.

A further improvement in the stacking properties is achieved through the positive fitting of the lower rolled lip with the geometrical form of the stopping face. In a specific step in the production of the outer sleeve, the form of the lower rolled lip is adapted to the form of the stopping face by means of a pressing element. Each stacked cup achieves a very exact fit because of this adaptation of the form of the lower rolled lip, so that very high stacks of cups, which do not tip over, are possible, because their centre of gravity does not travel out over the standing surface, as a result of which a temporary setting down, for example in the case of the filling of magazine, can be carried out without any risk.

In particular the temperature of the liquid which fills the cup is the basis for the insulating properties of the cup. The thickness of the material of the inner sleeve, followed by the size of the gap between the inner sleeve and the outer sleeve and the material thickness of the outer sleeve all determine the decrease in temperature between the liquid in the cup and the hand which holds said cup. In the case of the usual mass per unit area of the paperboard of the inner and outer sleeve, the gap between the inner and outer sleeves measures as a rule approximately 1.2 mm. Thus, when a cup is filled with a liquid having a temperature of 80° C., this permits an outer temperature of below 60° C., which means that the cup can be held in the hand for a longer period of time without causing pain.

As a result of the optimized stiffness of the inner sleeve of a cup according to the present invention, a saving in material of approximately 15% is made, without the cup losing noticeably in stiffness. The reduced insulating properties arising from the economization in material can be compensated for by a gap increase of approximately 0.2 mm between the inner and outer sleeve.

The present invention also relates to a process for making the cups. An inner cup is produced in preliminary procedural steps (not described here) to the stage where it is equipped with an upper rolled lip and a cup bottom.

The application of the stopping face takes place in a forming station which is integrated into the process line for manufacturing the inner cup and which consists of the elements of a container take-up, a core mandrel and a pressing ring. The core mandrel determines the shape and the properties of the stopping face by means of its cylindrical part and the size of its discontinuous change in diameter. In order to apply the stopping face, the inner sleeve is moved into the cup take-up when the forming station is open. The core mandrel and the press ring have been moved apart to such an extent that an inner sleeve can be mounted on the cup take-up. The parts of the forming station subsequently move forward again, that is the core mandrel and the press ring move towards one another, which movement is denoted in FIG. 10 with arrows. When the forming station has moved together so far that the press ring has reached the cylindrical part of the core mandrel, then a positive fit of the press ring, the inner sleeve and the core mandrel is achieved. The geometrical features of the press ring and the core mandrel are adapted in such a way that the press ring forms a cylindrical part of the inner sleeve while the forming station continues to move together, thus forcing a small percentage of the cup sleeve material towards the stopping face. Thus in the closed position of the forming station a material thickening in the cylindrical part of the originally conical inner cup, and a material strengthening in the stopping face, is achieved. This is possible because the fibre alignment of the wall of the inner cup is identical to the direction of movement of the press ring and the materials used are compressible and the fibres of the material can be elongated.

For very defined stopping faces, whose angle of inclination measures less than 20°, the forming station can be heated in order to improve the flowability of the synthetic layer. Temperatures of between approximately 70° C. and 90° C., which can be generated by means of a warm airstream or by heating the station electrically, lead to good ductility and flowability of the inner layer.

In the next manufacturing step the forming station is again moved apart and the inner cup is transferred to other stations in which it is fitted with an outer sleeve, joined and finished.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
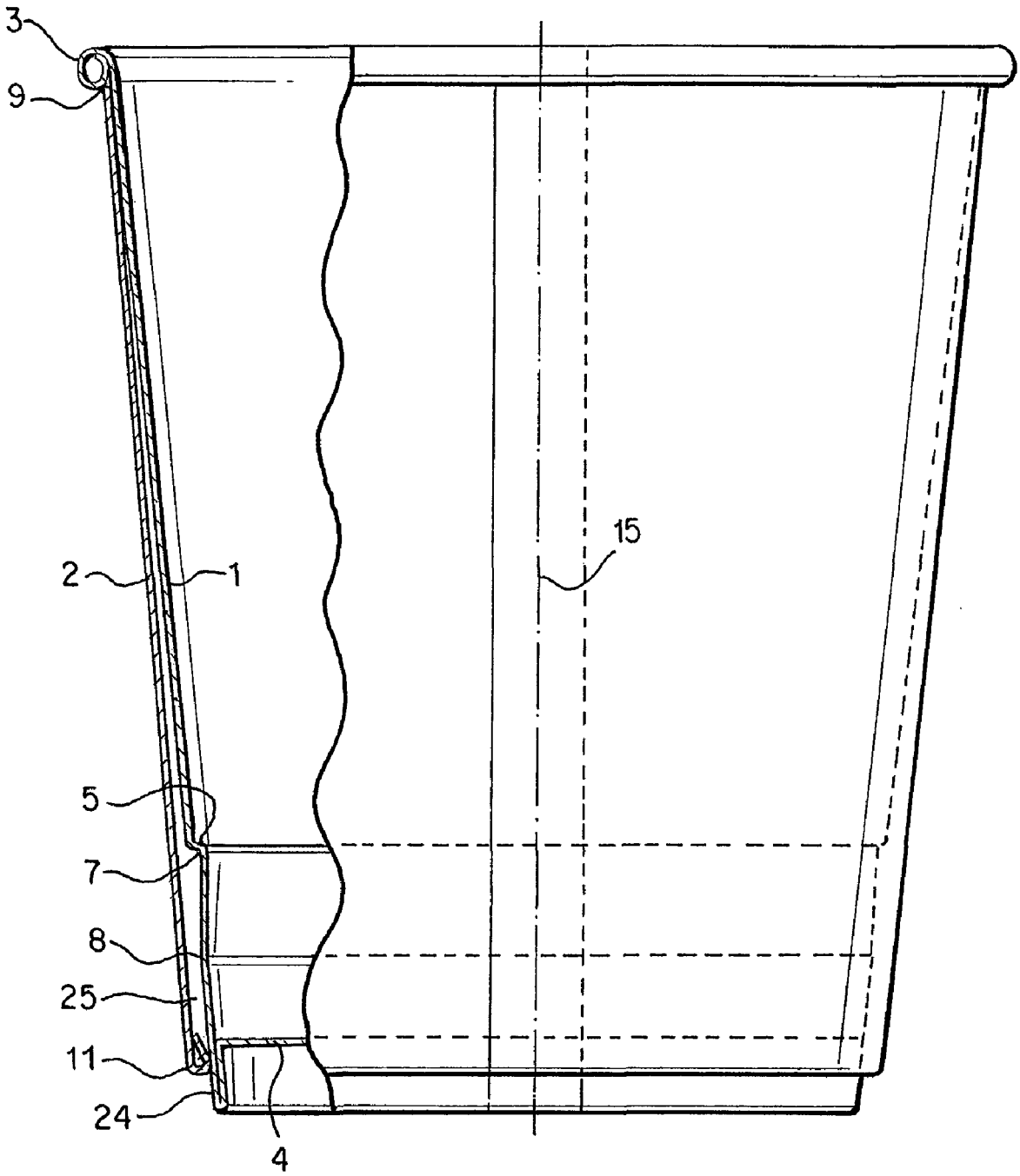
FIG. 1 shows a longitudinal section of a first embodiment of a stackable, heat-insulating cup.

The heat-insulating cup shown as a longitudinal section in FIG. 1 consists of an inner cup comprising an inner sleeve (1) and a cup bottom (4), and of an outer sleeve (2). A rolled lip (3) is applied to the inner sleeve (1) and a cup bottom (4) is inserted. The stacking properties of the cup are determined by a stopping face (5), the depth of the indentation (p) (see FIG. 3), and by a cylindrical area (7) to (8) located below the stopping face (5). The symmetry axis (15) of the cup serves to demonstrate the angle of inclination ($\alpha$) (see FIGS. 3 and 4) of the stopping face (5) and is only an imaginary line. The outer sleeve (2) is attached on the outside to the inner sleeve (1) in the area of the cup opening below the upper rolled lip (3). The outer sleeve (2) is provided at its lower end with a lower rolled lip (11) which is rolled inwards. The embodiment of the upper support (9), a possible upper shoulder (12) (see FIG. 8) and the lower rolled lip (11) define the insulating properties of the cup.

Figure 2:
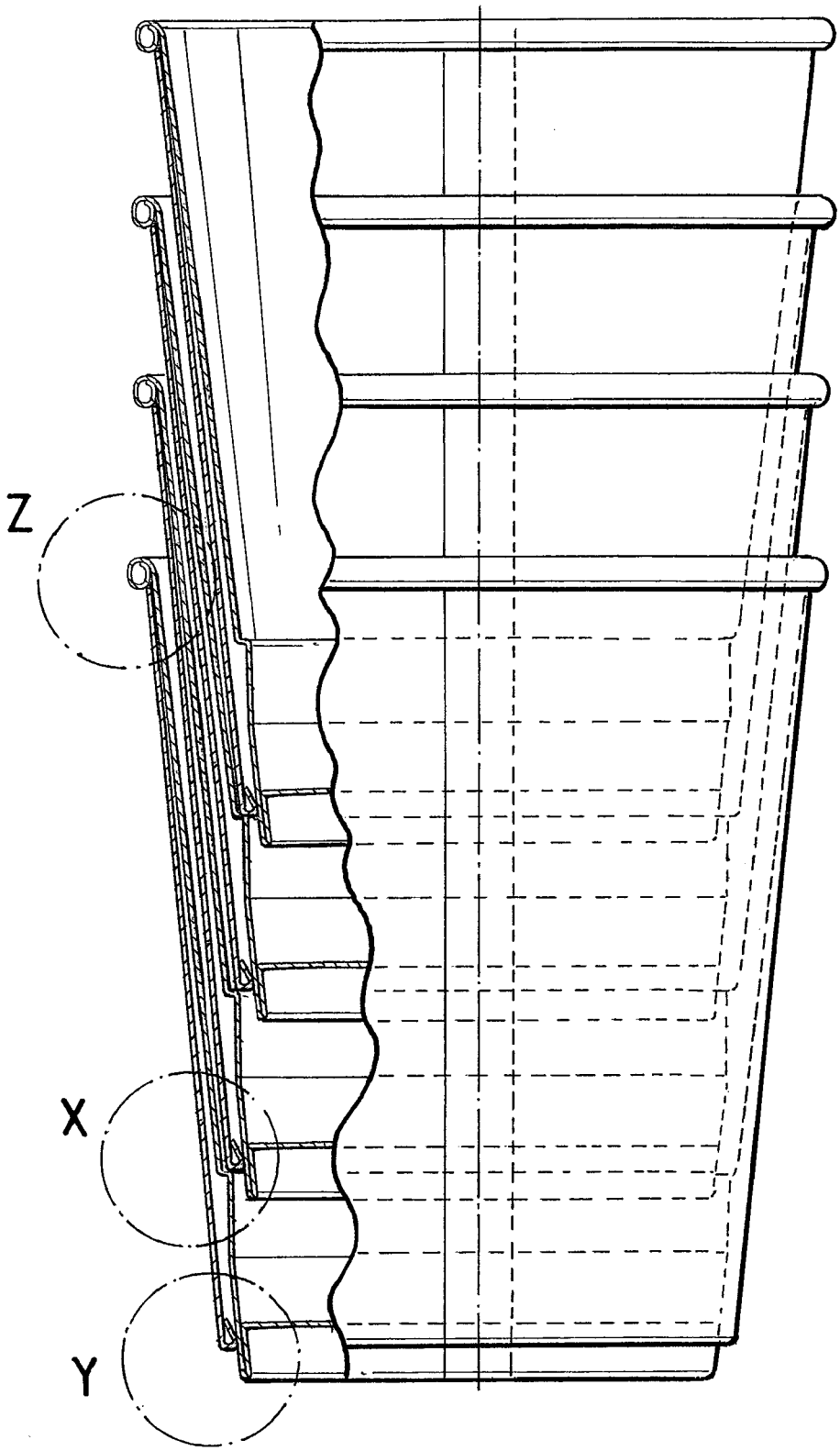
FIG. 2 shows four stacked cups of the cup shown in FIG. 1.
Figure 3:
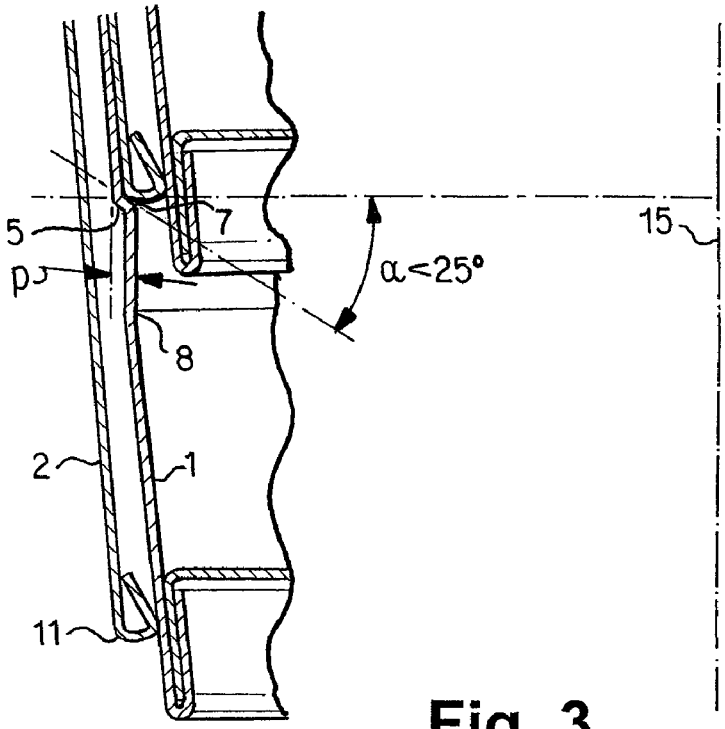
FIG. 3 shows the embodiment of a stopping face having an angle of inclination of 25°.
Figure 4:
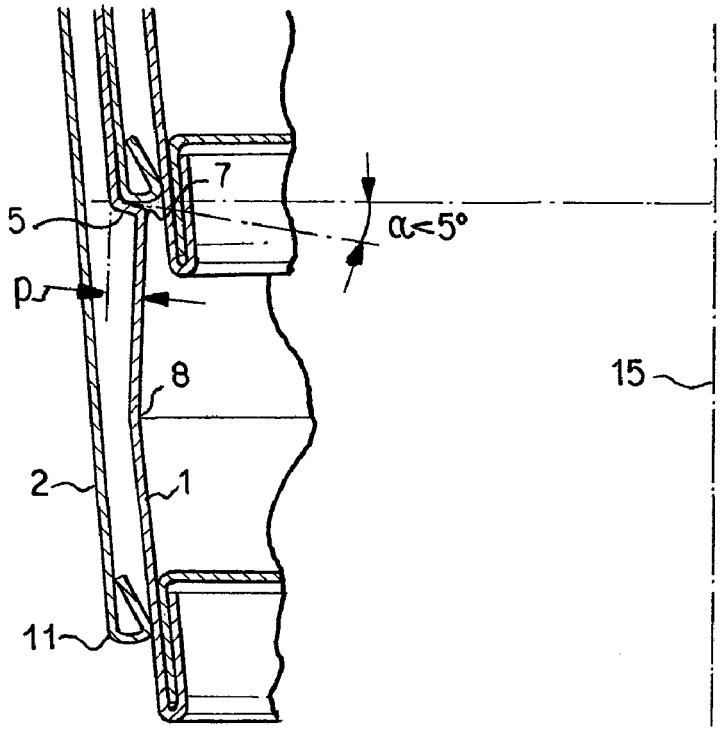
FIG. 4 shows the embodiment of a stopping face having an angle of inclination of 5°.
Figure 5:
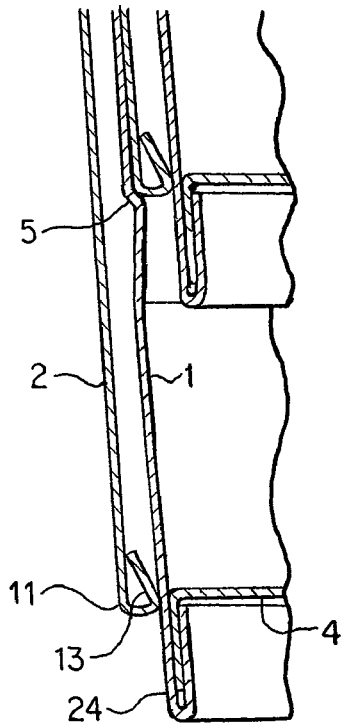
FIG. 5 shows the application of the lower rolled lip at the level of the cup bottom.
Figure 6:
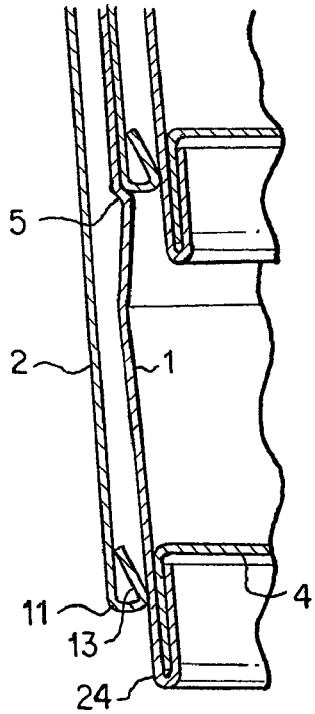
FIG. 6 shows the application of the lower rolled lip below the cup bottom.
Figure 7:
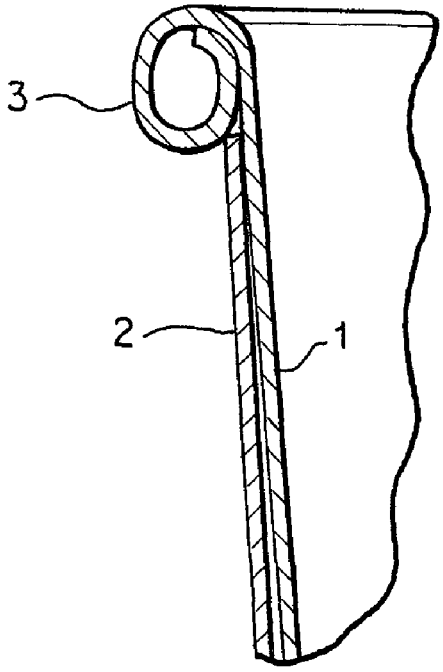
FIG. 7 shows the embodiment of a cup in the area of an upper rolled lip without an upper shoulder.
Figure 8:
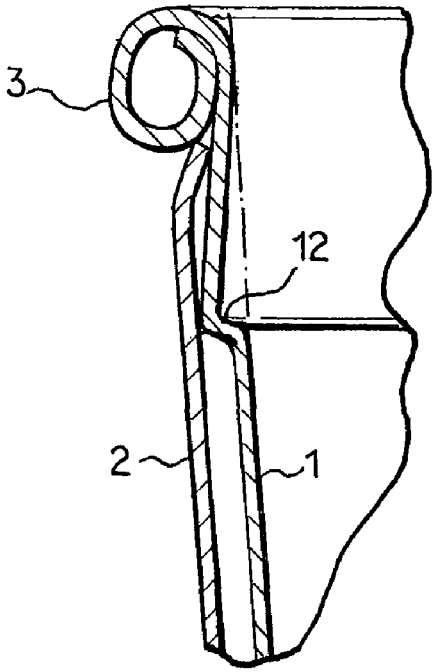
FIG. 8 shows the embodiment of a cup in the area of an upper rolled lip with an upper shoulder.

FIG. 2 shows four stacked cups whereby three areas are marked which are shown enlarged in further Figures. The marked area "X" is shown in FIGS. 3 and 4 in order to illustrate the embodiments of two stopping faces (5). The marked area "Y" is shown in FIGS. 5 and 6 in order to illustrate the embodiments of the support (13) of the lower rolled lip (11). The marked area "Z" is shown in FIGS. 7 and 8 in order to illustrate the embodiment of the cup opening.

The stacking and unstacking properties of the cup are determined by the angle of inclination ($\alpha$) of the stopping face (5), the depth of the indentation (p) and the cylindrical area (7) to (8). FIG. 3 shows the stacking of a cup at one stopping face (5) having an angle of inclination ($\alpha$) of 25°. FIG. 4 shows the stacking of a cup at a stopping face (5) having an angle of inclination ($\alpha$) of 5°.

FIGS. 5 and 6 illustrate the improvement in the stability of the inner sleeve (1) by means of application of the lower rolled lip (11) at the level of the cup bottom (4) (FIG. 5) or below the cup bottom (4) (FIG. 6). If the cup is seized in the area of the lower rolled lip (11), a great amount of pressure can be exerted on the rolled lip (11) without the inner sleeve (1) deforming, because the rolled lip (11) transfers the pressure to the cup bottom (4) or to the lower rolled lip (24) only, due to its support (13). If the lower rolled lip (11) were applied above the cup bottom (4), the cross section of the inner cup could be deformed due to load transmission from the rolled lip (11) to the inner sleeve (1) if the lower rolled lip (11) were seized with too much pressure, for example when being removed from a magazine, which would lead to the cup getting stuck outside the cup behind it.

The upper area of the cup can have various designs, depending on the type or temperature of the liquid to be filled into the cup. An upper shoulder (12) is recommended for very hot liquid, which upper shoulder (12) increases the insulation area between the inner sleeve (1) and the outer sleeve (2) and which upper shoulder (12) is applied to the inner sleeve (1). This shoulder (12) is not required for moderate liquid temperatures. The embodiment without an upper shoulder (12) is shown in FIG. 7. The embodiment with the upper shoulder (12) is shown in FIG. 8.

Figure 9:
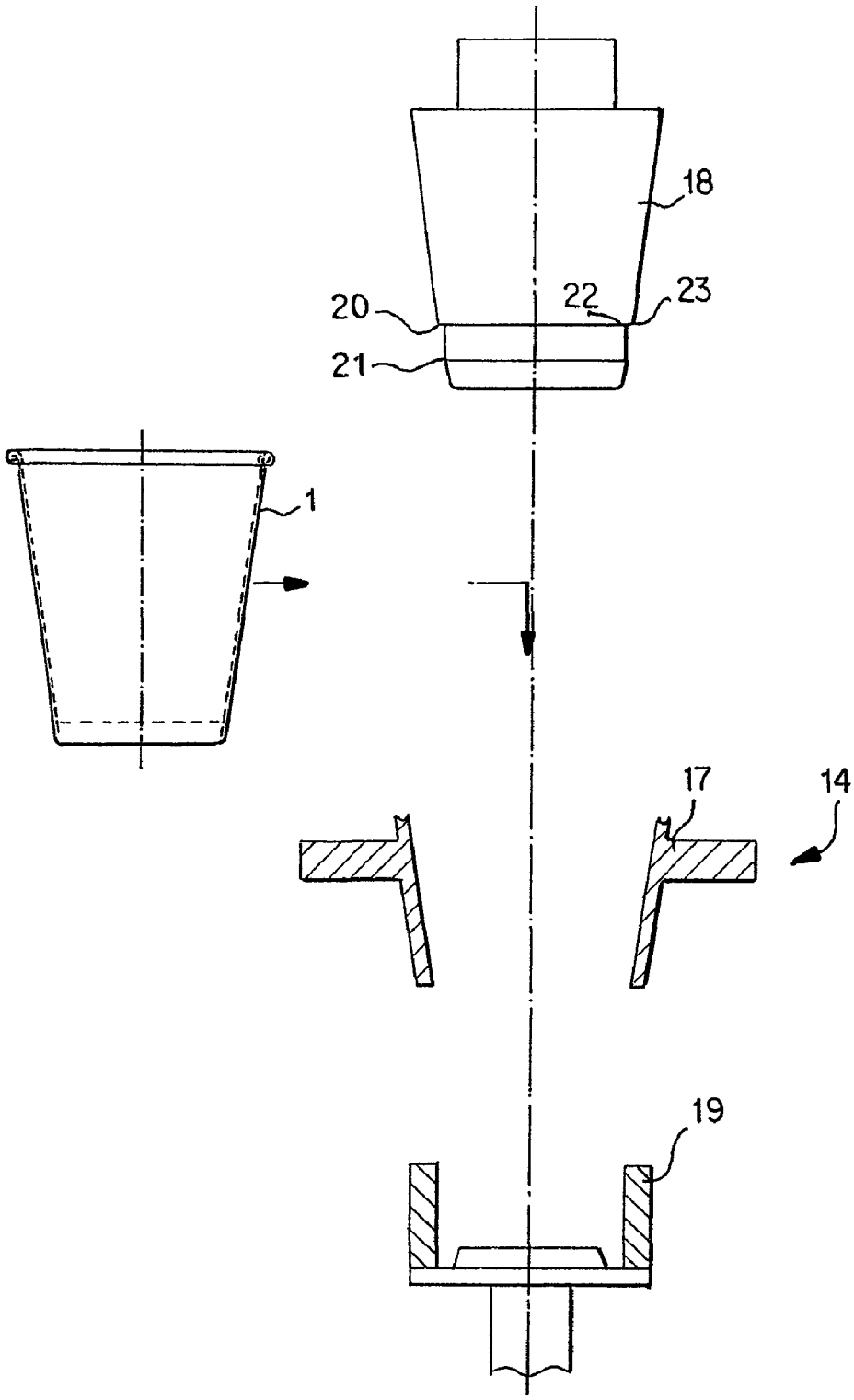
FIG. 9 shows the open, empty forming station.
Figure 10:
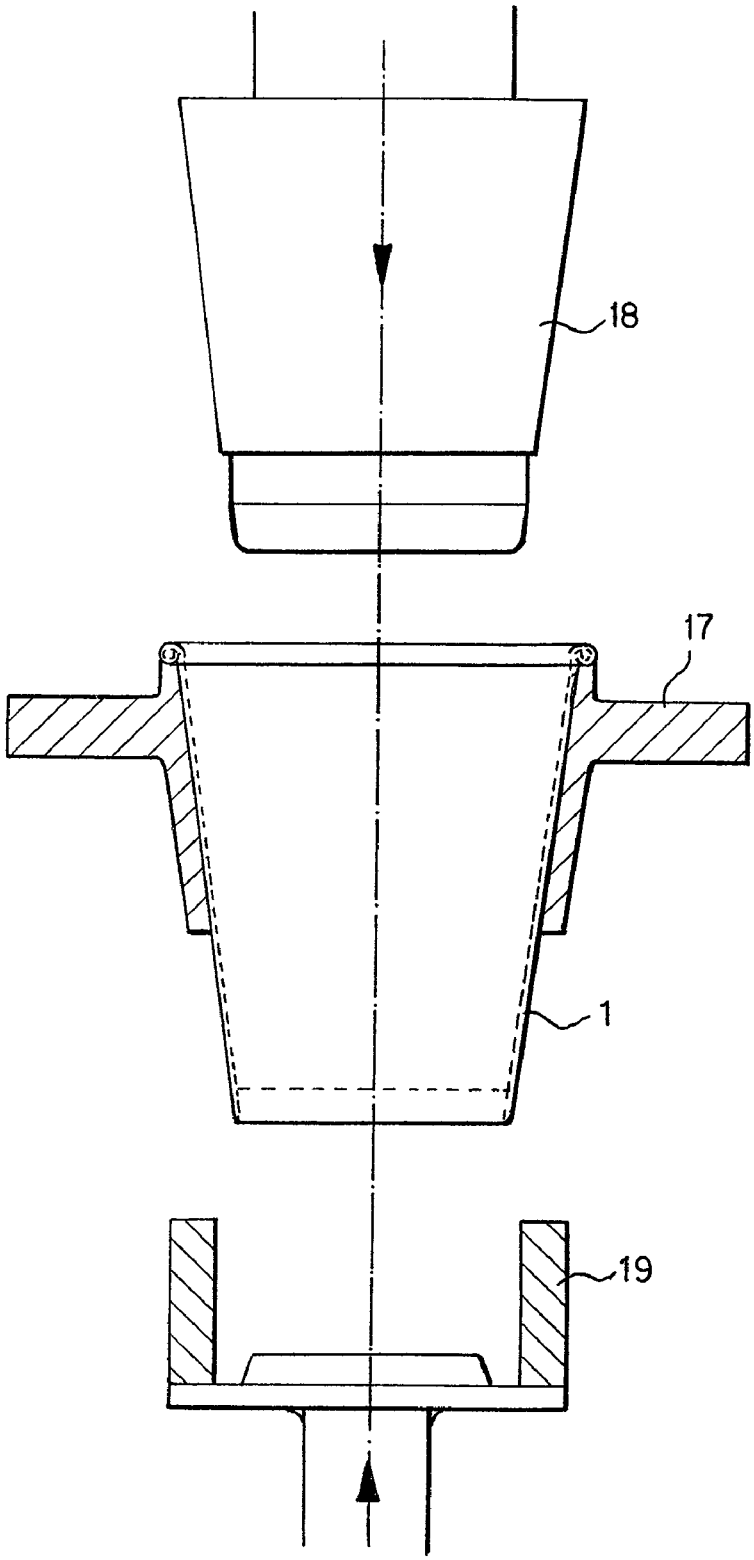
FIG. 10 shows the forming station equipped with an inner cup, whereby the pressing process has not yet been carried out.
Figure 11:
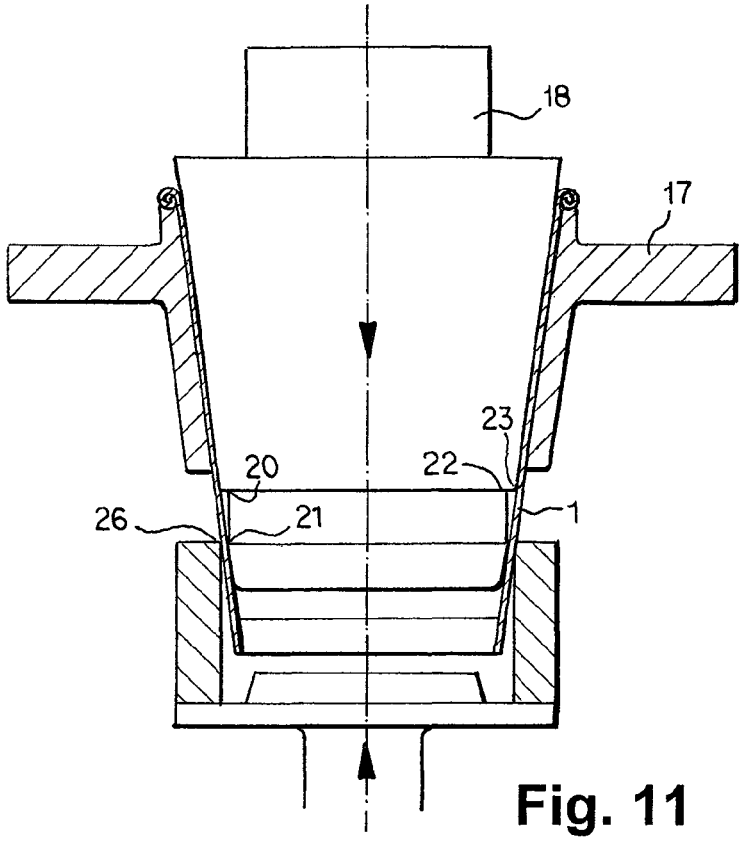
FIG. 11 shows the first contact between press ring, inner cup and core mandrel.
Figure 12:
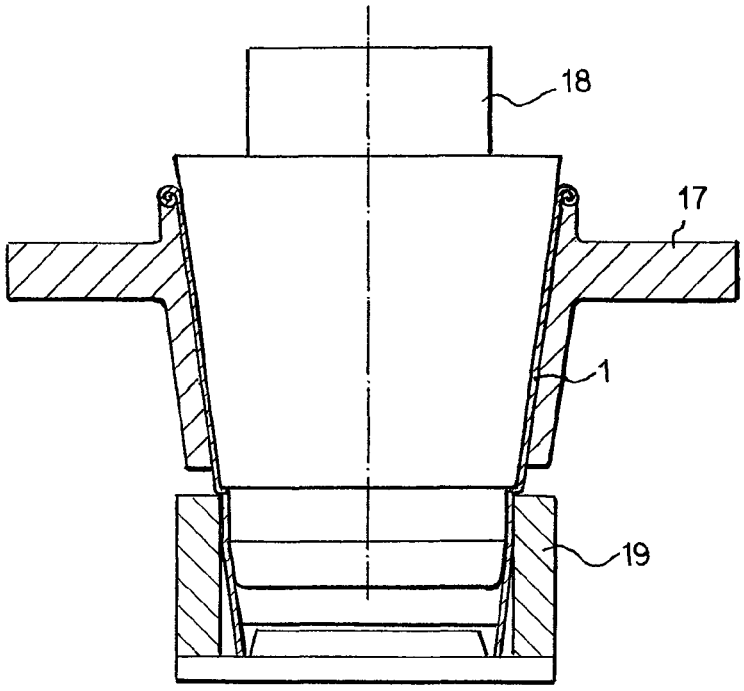
FIG. 12 shows the completely closed forming station.
Figure 13:
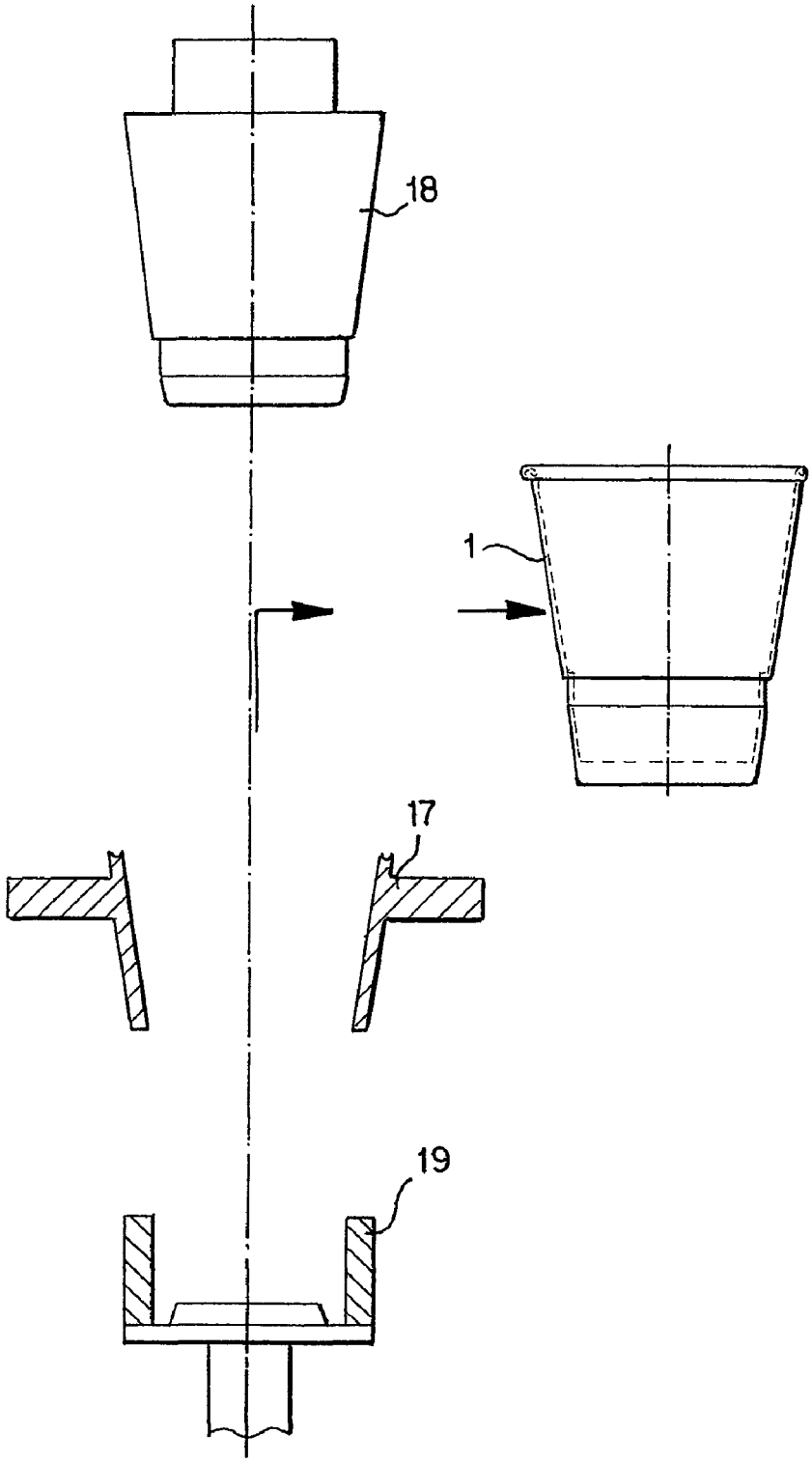
FIG. 13 shows the forming station completely open after the pressing process with the removal of the inner cup.

The forming of the stopping face (5) takes place in a forming station (14). The inner cup containing the cup bottom (4) is transferred to the cup take-up (17) of the forming station (14) (see FIG. 9). The forming station (14) is subsequently closed together. A core mandrel (18) of the forming station (14) is moved into the inner cup and the pressing ring (19) moves over the inner cup from the outside, as shown in FIG. 10. The core mandrel (18) comprises a cylindrical area (20) to (21) (FIG. 11) and a diameter discontinuity (22) to (23), which determine the form of the stopping face (5) of the inner sleeve (1) and the height of its cylindrical area (7) to (8). If the upper edge (26) of the pressing ring (19) reaches the beginning of the cylindrical area (21) of the core mandrel (18), then the forming of the inner sleeve (1) begins. This state is shown in FIG. 11. The moving of the forming station (14) to the closed state (FIG. 12) ends the forming of the stopping face (5). In the last procedural step of the pressing process (FIG. 13), the forming station is again opened completely and the inner cup is released.

What is claimed is:

1. A process for manufacturing a double-walled paperboard cup, the process including the acts of:

feeding an inner sleeve, on which an upper rolled lip is applied and in which a cup bottom is inserted, to a forming station having a core mandrel, a cup take-up and a pressing ring;

inserting the core mandrel into inner sleeve;

forming a stopping face designed as a shoulder located at a lower portion of the inner sleeve at which a diameter of the inner sleeve is reduced discontinuously, in the forming station, by sliding the pressing ring onto the inner sleeve and the core mandrel; and opening the forming station and transporting the inner sleeve for completion of the double-walled cup to processing stations in which the inner sleeve is joined to an outer sleeve, wherein the stopping face is formed simultaneously about a circumference of the inner sleeve by the sliding of the pressing ring onto the inner sleeve and the core mandrel.

2. A process according to claim 1, wherein the act of forming the stopping face is carried out at an increased temperature at least during the sliding of the pressing ring onto the inner sleeve and the core mandrel.

3. The process according to claim 1, wherein the pressing ring is slid onto the inner sleeve along a longitudinal axis of the inner sleeve.

4. The process according to claim 1, wherein the pressing ring is slid onto the inner sleeve in a direction from a bottom of the inner sleeve toward a top of the inner sleeve.

* * * * *